US010150022B1

(12) United States Patent
Robino

(10) Patent No.: US 10,150,022 B1
(45) Date of Patent: Dec. 11, 2018

(54) BALL, THROWING ROD, AND TARGET ASSEMBLY AND METHOD FOR PLAYING A GOLF-TYPE GAME

(71) Applicant: John Barry Robino, Medford, OR (US)

(72) Inventor: John Barry Robino, Medford, OR (US)

( * ) Notice: Subject to any disclaimer, the term of this patent is extended or adjusted under 35 U.S.C. 154(b) by 0 days.

(21) Appl. No.: 15/612,966

(22) Filed: Jun. 2, 2017

Related U.S. Application Data

(60) Provisional application No. 62/491,403, filed on Apr. 28, 2017.

(51) Int. Cl.

| | |
|---|---|
| ***A63B 67/02*** | (2006.01) |
| ***A63B 63/08*** | (2006.01) |
| ***A63B 67/06*** | (2006.01) |
| ***A63B 65/12*** | (2006.01) |

(52) U.S. Cl.
CPC ..... *A63B 67/02* (2013.01); *A63B 63/08* (2013.01); *A63B 65/122* (2013.01); *A63B 67/06* (2013.01); *A63B 2209/00* (2013.01)

(58) Field of Classification Search
CPC ..... A63B 67/02; A63B 63/08; A63B 67/06; A63B 65/122; A63B 2209/00
See application file for complete search history.

(56) References Cited

U.S. PATENT DOCUMENTS

| | | | | |
|---|---|---|---|---|
| D183,084 | S | 6/1958 | Carlson | |
| 3,392,978 | A | 3/1968 | Wiest, Jr. | |
| 3,586,329 | A | 6/1971 | Spreitzer | |
| 4,157,828 | A * | 6/1979 | Cosmopulos | A63B 59/30 124/5 |
| 4,273,339 | A | 6/1981 | Fortunato | |
| 4,548,413 | A * | 10/1985 | David | A63B 69/3632 124/5 |
| 5,290,039 | A | 3/1994 | Cornelio | |
| 5,573,176 | A * | 11/1996 | Applegate | B65D 5/5045 220/9.1 |
| D637,248 | S | 5/2011 | Levin et al. | |
| 8,015,968 | B2 | 9/2011 | Christ | |
| 8,418,681 | B2 | 4/2013 | Levin et al. | |
| 8,539,939 | B2 | 9/2013 | Minneman et al. | |
| 8,857,419 | B2 | 10/2014 | Hansen | |
| 8,887,707 | B2 | 11/2014 | Minneman et al. | |
| D729,329 | S | 5/2015 | Williams | |
| 9,149,695 | B2 | 10/2015 | Evans | |

(Continued)

*Primary Examiner* — Gene Kim
*Assistant Examiner* — Jeffrey Vanderveen
(74) *Attorney, Agent, or Firm* — Jerry Haynes Law

(57) ABSTRACT

A kit and method for playing and providing training for a golf-type game comprising at least one ball, at least one throwing apparatus such as a throwing rod, and at least one target unit, wherein golf-type game is played similar to golf, except that instead of golf clubs, a throwing rod advances a ball towards at least one target. Further the target unit is a container that contains a weighted granular substance. The throwing rod is operable to enable a player to grasp the rod by a handle, retain the ball between a pair of elongated, arced rails, and throw the ball with a whip-like motion over a long distance towards the target, much the same way as a driver used in a typical golf game. Further, the throwing rod is also adapted to enable the player to putt the ball towards the target for shorter distances.

21 Claims, 5 Drawing Sheets

(56) References Cited

U.S. PATENT DOCUMENTS

| | | | | |
|---|---|---|---|---|
| D758,511 | S | 6/2016 | Williams | |
| D768,796 | S | 10/2016 | Evans et al. | |
| D781,974 | S | 3/2017 | Nimes et al. | |
| 2006/0229136 | A1 | 10/2006 | Presley | |
| 2007/0102884 | A1* | 5/2007 | Hinz | A63B 67/002 273/348 |
| 2009/0075743 | A1* | 3/2009 | Hogan | A63B 47/002 473/133 |
| 2014/0121040 | A1* | 5/2014 | Cappello | A63B 69/00 473/432 |
| 2014/0144417 | A1* | 5/2014 | Evans | A63B 59/20 124/5 |
| 2014/0196669 | A1* | 7/2014 | Barr | A01K 1/0107 119/498 |
| 2015/0007803 | A1 | 1/2015 | Van Alen et al. | |
| 2015/0018129 | A1 | 1/2015 | Van Alen et al. | |
| 2015/0090237 | A1 | 4/2015 | Williams | |
| 2015/0297964 | A1 | 10/2015 | Evans | |
| 2016/0096093 | A1 | 4/2016 | Evans | |
| 2016/0096095 | A1 | 4/2016 | Williams | |

* cited by examiner

BALL, THROWING ROD, AND TARGET ASSEMBLY AND METHOD FOR PLAYING A GOLF-TYPE GAME

CROSS-REFERENCE TO RELATED APPLICATIONS

This application claims priority from U.S. Provisional Application Ser. No. 62/491,403, entitled "Ball, Throwing Rod, and Target Assembly and Method for Playing a Golf-Type Game", filed on Apr. 28, 2017, which application is hereby incorporated herein by reference in its entirety.

FIELD OF THE INVENTION

The present invention relates generally to a kit and method for playing a golf-type game and more particularly it relates to a kit and method for playing a golf-type game comprising at least one ball, at least one throwing apparatus, and at least one target unit.

BACKGROUND OF THE INVENTION

Many handheld devices for assisting a person in throwing a generally spherical object are known in the art. Examples of some such devices include lacrosse sticks and jai alai cestas or a xistera, another throwing device is a lacrosse stick, also known as a crosse, having a long-handled meshed scoop. Also, children's toys have been developed for playing catch with lightweight balls. A safe, easy to use, and economical to manufacture throwing apparatus is a long felt need for playing golf-type games. Golf is a popular game, but despite of its popularity, golf remains expensive, the equipment can be costly and the game is time consuming to learn. Only golf players with experience and a high level of skill can predictably and repeatedly obtain the ball spin they desire, and they use such spin within their game to direct the trajectory of their shots to efficiently play the game with minimum number of strokes.

Within the recreational equipment market, there is still a need for a kit and method of operation to help a player to achieve a higher level of competence by developing a better swing or by achieving a marginal level of increased proficiency over competitors.

Further, there is need for a throwing apparatus of the present invention allowing wider scope to play several golf-type games and further the target unit eliminates the need of a well maintained and costlier golf course for practicing or playing a golf-type game.

Numerous innovations have been provided in prior art that are adapted to a throwing apparatus and its method of operation. Even though these innovations may be suitable for the specific purposes to which they address, however, they would not be as suitable for the purposes of the present invention.

For example, U.S. Design Pat. No. D183,084 to Carlson discloses an ornamental design for a ball catching and throwing device. U.S. Design Pat. No. D637,248 to Levin et al. describes an ornamental design for a ball thrower. U.S. Design Pat. No. D729,329 to Williams teaches an ornamental design for a ball throwing toy. U.S. Design Pat. No. D748,748 to Van Alen et al. discloses an ornamental design for an athletic stick head. U.S. Design Pat. No. D58,511 to Williams describes an ornamental design for a pet toy thrower. U.S. Design Pat. No. D768,796 to Evans et al. teaches an ornamental design for a projectile throwing apparatus. U.S. Design Pat. No. D781,974 to Nimes et al. discloses an ornamental design for a toy ball catcher. U.S. Design Pat. No. D782,588 to Fryer et al. describes an ornamental design for a projectile launching device.

U.S. Pat. No. 3,392,978 to Wiest Jr. discloses a ball projecting and catching device comprising a hand held projecting and catching device for maintaining a ball in a continuous orbit. It includes a catching portion disposed atop a delivery chute and terminating in a tossing spoon having an angularly disposed front wall which projects the ball backwardly toward the catching portion when the spoon is quickly elevated.

U.S. Pat. No. 3,586,329 to Spreitzer describes a roll and catch toy involve the progressive advance of a ball from one end of an arched track to the other end where it drops through an opening and may be caught in a receptacle located remote from said opening.

U.S. Pat. No. 4,273,339 to Fortunato teaches a molded plastic cesta formed with all but the glove portion defined by a single integrally molded plastic part or body portion, the pilota launching surface of which is generally straight and integrally connected to an arcuate inner ramp surface which is integrally connected to a second straight segment oriented perpendicular to the first or launching surface.

U.S. Pat. No. 4,548,413 to David discloses a game device for holding and propelling a ball therefrom upon swinging movement which includes an elongated shaft having a chute member for holding the ball. The chute member is pivoted to the shaft for swinging movement through approximately a 180° arc and the shaft itself is intended to be held similarly as a golf club for swinging movement through an arc of swing in the manner of a golf club for propelling the ball therefrom.

U.S. Pat. No. 5,290,039 to Cornelio describes a unitary ball hurling and catching scoop comprising a crescent-shaped receptacle and handle segments. The receptacle segment includes a remote up-sloped section connected to a pocket section. The pocket section is connected to the handle segment.

U.S. Pat. No. 8,015,968 to Christ teaches a throwing device that includes an approximately straight and elongated shaft extending distally from a proximal end thereof to a distal portion of the device. The distal portion includes a projectile retainer and a projectile track extending distally from the retainer to a distal tip of the device. The projectile retainer, when in a closed position, holds a projectile in a fixed position with respect to the device. When the shaft is gripped and swung through an arc, the retainer opens to release the projectile along the projectile track, by the swinging motion.

U.S. Pat. No. 8,418,681 to Levin et al. discloses a ball thrower comprising a throwing end and a reserve end. The throwing end provides for a ball to be held and released from the ball thrower during a throwing motion. The reserve end provides a compartment to hold the ball securely when the ball thrower is not in use. Further, a first and a second ball may be maintained at the throwing end and at the reserve end, respectively.

U.S. Pat. Nos. 8,539,939 and 8,887,707 to Minneman et al. describes a hand held disk thrower consisting of a pivoting extended arm and launching head connected to a gripping handle that allows a wide ratios secondary action. The launch head and arm section are attached to the handle by a pivoting joint that allows for a free or flopping movement of a head arm section. The thrower is designed to release a spinning disk when swung in an arc by the user.

U.S. Pat. No. 8,857,419 to Hansen teaches a pet ball launcher comprising a pivot hinged handle for added launch inertia, and a thumb latch to prevent hinging motion for fixed and controlled distanced ball launching. The launcher uses a friction fit, scoop edges, and tuned tines or "fingers" to provide control release of the ball.

U.S. Pat. No. 9,149,695 to Evans describes a projectile throwing apparatus comprising a handle, an elongate shaft, and a throwing head for throwing a projectile, such as a golf ball. The throwing head may be interchangeable with golf shafts of varied lengths, with lacrosse shafts, or other shafts to achieve accurate, long distance golf ball throws. The throwing head may be shaped to achieve throws of different distance, launch angle, and trajectory, optionally imparting spin with a retrograde ramp at the distal end of the throwing head. The throwing apparatus is useful for golf-type game play, including for those with physical disabilities, as well as for a training and instructional aid for golf, lacrosse, and other sports.

U.S. Patent Application No. 20060229136 to Presley teaches an alternative to the game of golf utilizing any conventional golf course while incorporating a plurality of elevated target disks having a vertical planar attitude and a circular central opening, a ball having an outer diameter substantially lesser than that of the circular central opening in the target disks, and a variety of ball launchers each having the ability to accept various handle implements. The goal of the game is to either strike or penetrate the target disks in as few tosses as possible from the T-off point.

U.S. Patent Application Nos. 20150007803 and 20150018129 to Van Alen et al. disclose a game stick comprising a shaft with a head at one end, wherein the head comprises a channel. A ball is placed in the channel and when the game stick is swung, the ball rides along the channel and is released therefrom to fly through the air. The head may be adjustable to affect the way in which the ball is thrown. The game is similar to golf except that instead of hitting the ball, the ball is thrown toward a target location at the end of a fairway. When the target location is reached, the game stick may be used as a putter to push or putt the ball to sink it into a sunken cup in the ground.

U.S. Patent Application No. 20150090237 to Williams describes a long-distance projectile throwing toy comprising a launching section hingedly attached at one end to a handle section. The distal end of the launching section includes a ball holder for releasably securing a ball/projectile loosely enough to allow the ball to fly out of the ball holder when the device is whipped by the user.

U.S. Patent Application No. 20160096095 to Williams teaches a disc projectile throwing toy includes a disc placed in and thrown from the toy, a handle section, and a launching section hinged to and whippably rotatable with respect to the handle section. The distal end of the launching section includes a disc holder adapted to releasably hold the disc.

It is apparent now that numerous innovations for a throwing apparatus have been developed in the prior art that are adequate for various purposes. Furthermore, even though these innovations may be suitable for the specific purposes to which they address, accordingly, they would not be suitable for the purposes of the present invention as heretofore described. Thus a kit and method for playing a golf-type game comprising at least one ball, at least one throwing apparatus such as a throwing rod, and at least one target unit is needed.

SUMMARY OF THE INVENTION

The present invention discloses a kit and method for playing and providing training for a golf-type game. With the above-noted prior art and inadequacies in mind, it is an object of the present invention to provide a kit and method for playing and providing training for a golf-type game comprising at least one ball, at least one throwing rod, and at least one target unit.

According to one aspect a kit and method for playing and practicing alternative game of golf, wherein the kit includes: at least one ball; at least one target unit having a container and a weighted granular substance; and at least one throwing apparatus, wherein the throwing apparatus includes a pair of rails, at least one bridge extending between the pair of rails, a handle and a hinge joint between the pair of rails and the handle, whereby the pair of rails is defined by a generally elongated, arced pair of rails having a rail junction end and a rail terminus end, the pair of rails arranged in a parallel, spaced-apart relationship, further the arced pair of rails are configured to retain and carry the ball across the pair of rails, whereby the handle is defined by an elongated handle having a handle junction end and a handle terminus end, whereby the hinge joint is configured to pivotally and interchangeably join the pair of rails at the rail junction end with the handle at the handle junction end at a predetermined angle, whereby manipulation of the hinge forms a snug relationship between the pair of rails relative and the handle, whereby a whip-like throwing motion generates sufficient momentum to carry the ball towards the rail terminus end for throwing the ball towards the target.

In view of the foregoing, it is therefore an object of the present invention to provide a safe, easy to use, inexpensive and easy to manufacture kit for a golf-type game.

It is another object of the present invention to play a golf-type game with a throwing apparatus, rather than multiple golf clubs.

It is another object of the present invention to provide a kit and its method of operation to help a player achieve a higher level of competence by developing a better swing or by achieving an increased proficiency level versus competitors.

It is another object of the present invention to provide a throwing apparatus that serves the dual purpose of throwing and putting a ball.

It is another object of the present invention to provide golf-type game play, including for those with physical disabilities, as well as for a training and instructional aid for golf, lacrosse, and other sports.

It is another object of the present invention to alter the launch angle, speed, trajectory, and spin of the ball dependent at least partially on the angle of the rails of the apparatus relative to its handle; length of the rails; degree of curvature of the rails; and the momentum generated with a whip-like throwing action.

It is another object of the present invention to throw the ball into targets in the fewest number of throws or strokes.

It is another object of the present invention to provide a throwing apparatus that can be used by one hand in contrast to a golf club that requires a two-handed grip to swing.

It is another object of the present invention to provide a kit comprising at least one throwing apparatus that can be used by special needs golfers for practicing or playing a golf-type game while being seated and using only one hand.

It is another object of the present invention to provide a kit comprising at least one target unit that eliminates the need of a well maintained and costly golf course for practicing or playing a golf-type game.

It is another object of the present invention to provide a kit comprising eighteen target units that are used to play a golf-type game.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
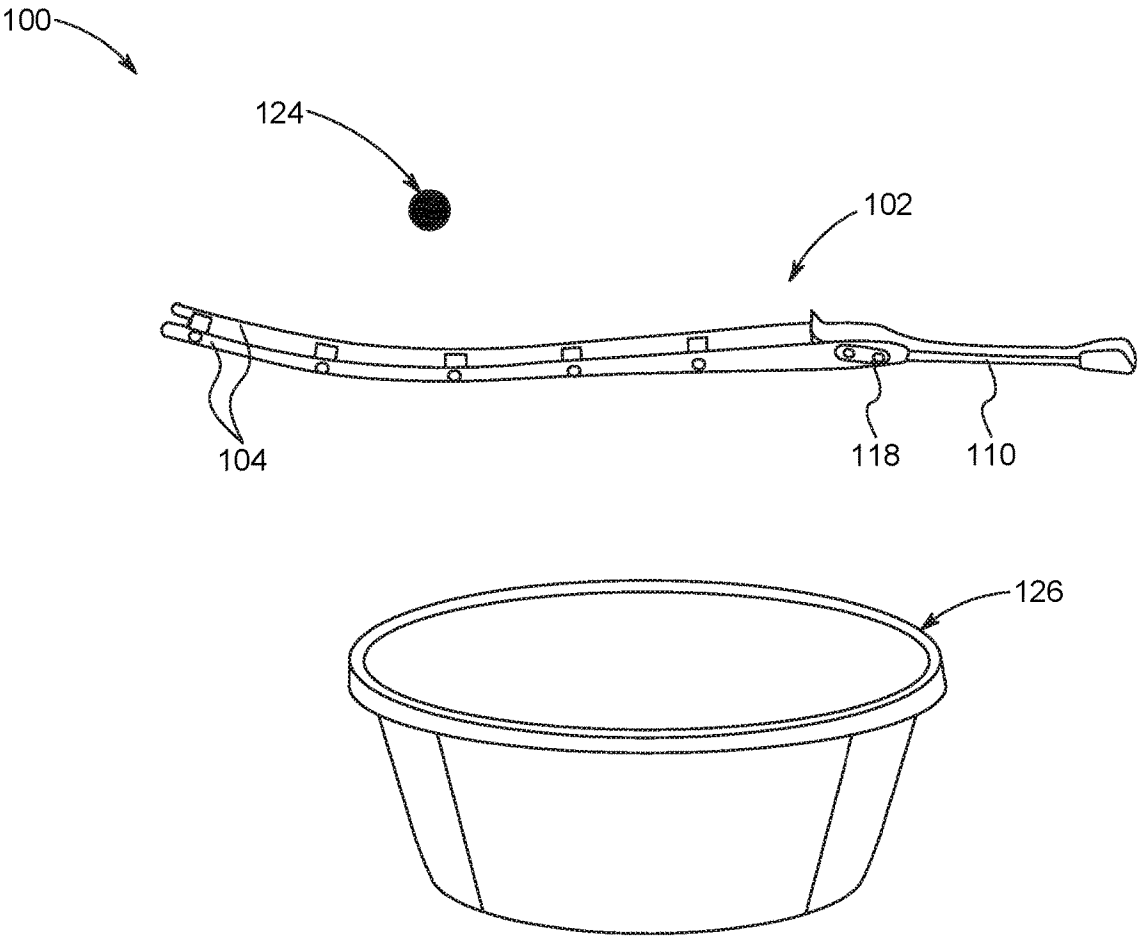
FIG. 1 illustrates a kit comprising a ball, a throwing apparatus, and a target unit, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A method 200 and an assembly or a kit 100 comprising a ball, a throwing apparatus such as a throwing rod, and a target for and practicing alternative game of golf is referenced in FIGS. 1-6. The assembly 100 and method 200 provides a game that is substantially similar to golf in objectives and rules, except that instead of multiple golf clubs, a throwing apparatus 102 is used to advance a ball 124 towards at least one target 126, such as a container that contains weighted granular substance 132.

In some embodiments, the throwing apparatus 102 is operable to enable a player to grasp the throwing apparatus by a handle 110, retain the ball 124 between a pair of elongated, arced rails 104, and throw the ball 124 with a whip-like motion over a long distance towards the target 126, much the same way as a driver used in a typical golf game. Further, the throwing apparatus 102 is also adapted to enable the player to putt the ball 124 towards the target 126 for shorter distances, much the same way as a putter used in a typical golf game. In one embodiment of the putting function, the throwing apparatus 102 does not, however, strike the ball 124 as in a typical golf putter. Rather, the throwing apparatus 102 is aligned with the target 126. The ball 124 is then rolled down on the pair of elongated arced rails 104 towards the target 126.

The throwing apparatus 102 is defined by a pair of elongated, arced rails 104 that retain and carry the ball 124 towards a terminus end as the ball 124 builds momentum during the throw. The throwing stick or rod or apparatus 102 also comprises an elongated handle 110 for grasping the throwing stick 102. A hinge 118 forms at the junction between the rails 104 and the handle 110 to pivot the rails 104 in relation to the handle 110, and also to enable facilitated interchanging of the rails 104. Interchanging rails 104 can be used to achieve different rail lengths and arc curvatures.

In this manner, the launch angle, speed, trajectory, and spin of the ball 124 is at least partially dependent on: 1) the angle of the rails 104 relative to the handle 110; 2) the length of the rails 104; 3) the degree of curvature of the rails 104; and 4) the momentum generated with the whip-like throwing action. The at least one target unit 126 may include a container that contains a weighted granular substance 132, such as sand. In one embodiment of the golf-type game, multiple targets 126 are operable across multiple fields, or greens, similar to a golf game.

In one aspect, a throwing apparatus 102 comprising: a pair of rails 104, wherein the rails 104 are elongated, an arced pair of rails having a rail junction end 108 and a rail terminus end 106, the pair of rails 104 are arranged in a parallel, spaced-apart relationship; at least one bridge 116*a-c* extending between the pair of rails 104, wherein the arced pair of rails 104 are configured to retain a ball 124 across the pair of rails 104 and carry the ball 124 towards the rail terminus end 106 as the ball 124 builds momentum during the throw; a handle 110, wherein the handle 110 is defined by an elongated handle having a grip portion 111, a handle junction end 114 and a handle terminus end 112; and a hinge joint 118 between the pair of rails 104 and the handle 110, wherein the hinge joint 118 is configured to pivotally and detachably join the rail junction end 108 to the handle junction end 114, whereby manipulation of the hinge 118 forms a snug relationship between the pair of rails 104 relative and the handle 110, thereby a whip-like throwing motion generates sufficient momentum to carry the ball 124 towards the rail terminus end 106 for throwing the ball 124.

In another aspect, a ball 124, a throwing apparatus 102, and target 126 forming an assembly/kit 100, wherein the assembly 100 comprises: a throwing apparatus 102 defined by a generally elongated, arced pair of rails 104 having a rail junction end 108 and a rail terminus end 106, the pair of rails 104 arranged in a parallel, spaced-apart relationship, the throwing apparatus 102 further defined by an elongated handle 110 having a handle junction end 114 and a handle terminus end 112; at least one bridge 116*a-c* extending between the pair of rails 104 in a spaced-apart relationship; a hinge 118 configured to pivotally join the rail junction end 108 to the handle junction end 114, whereby manipulation of the hinge 118 forms a snug relationship between the pair of rails 104 and the handle 110, whereby manipulation of the hinge 118 detaches the pair of rails 104 from the handle 110; a ball 124 configured to travel across the pair of rails 104, whereby a whip-like throwing motion generates sufficient momentum to carry the ball 124 towards the rail terminus end 106 for throwing the ball 124; and at least one target comprising a target unit 126 such as a container and a weighted granular substance 132.

In another aspect of the present invention provides a method 200 for playing and practicing alternative game of golf with a kit 100 comprising at least one ball 124, at least one throwing apparatus 102 and at least one target unit 126, the method 200 comprising: providing the kit 100 comprising the throwing apparatus 102, wherein the throwing apparatus 102 is defined by a generally elongated, arced pair of rails 104 having a rail junction end 108 and a rail terminus end 106, the pair of rails 104 arranged in a parallel, spaced-apart relationship, the throwing apparatus 102 further defined by an elongated handle 110 having a handle junction end 114 and a handle terminus end 112; positioning the ball 124 on the pair of rails; pivoting the pair of rails 104 relative to the handle 110; aiming for at least one target 126; imparting a whip-like throwing motion on the throwing apparatus 102, whereby the whip-like throwing motion causes the ball 124 to launch from the rail terminus end 106 of the throwing apparatus 102 towards the at least one target 126; putting the ball 124 towards the at least one target 126; aligning the rails 104 towards the at least one target 126; releasing the ball 124 from the rail junction end 108 to the rail terminus end 106, so that the ball 124 rolls towards the at least one target 126; and repeating the above steps to throw or putt the ball 124 into all the targets 126 in the minimum number of attempts.

In another aspect, the hinge 118 comprises one or more screws 120*a*, nuts 120*b* and washers 121. Alternately, use of cap screws eliminates the use of washers.

In another aspect, the rail junction end 108 and the handle junction end 114 form at least one aperture 122*a*, 122*b* to enable passage of the screws 120*a* so as to be aligned with the nuts 120*b*.

In another aspect, eighteen target units 126 are used to play the golf-type game.

In another aspect, the target units, which is a container 126 is a fifteen gallon bucket or tub.

In another aspect, weighted granular substance 132 is sand.

In another aspect, the kit assembly 100 is operable on a golf course.

In another aspect, the angle of the rails 104 relative to the handle 110, the length of the rails 104, the degree of curvature of the rails 104, and the momentum generated with the whip-like action control the launch angle, speed, trajectory, and spin of the ball 124.

In another aspect, the pair of rails 104 can be interchanged with different rails having varying lengths and degrees of curvature.

In another aspect, the pair of rails 104 pivots about the hinge 118, whereby the hinge 118 comprises one or more nuts 120*b* and screws/bolts 120*a* that can be loosened to enable adjustability of the rails 104 relative to the handle 110 thereby controlling launch trajectory and speed of the ball 124.

In another aspect, the handle terminus end 112 includes a grip 111 for secure handling of the throwing apparatus 102.

In another aspect, the rails 104 are about 30 to 32 inch long.

In another aspect, the handle 110 is about 13 to 14 inch long.

In another aspect, the rail terminus end 106 is shaped and dimensioned to enable putting the ball 124 short distances towards the target 126 by directly striking the ball 124.

In another aspect, the handle terminus end 112 of the handle 110 sticks into the ground and the rails 104 are aligned with the target 126 then the ball 124 is rolled down the grooved rails 104 towards the target 126.

In another aspect, five dowels of ¾ inch are used between the rails 104 as bridges 116*a-c* to enhance the structural integrity of the throwing apparatus 102.

In another aspect, the target comprises eighteen target units 126, whereby each target unit 126 is an open container having a base of 26 inch diameter and side wall of 9.75 inch height.

One objective is to play a golf-type game with a throwing apparatus 102, rather than multiple golf clubs.

Another objective is to simplify the game of golf with a throwing apparatus 102, which is easier to operate than golf clubs.

Another objective is to provide a throwing apparatus 102 that serves the dual purpose of throwing and putting the ball 124.

Another objective is to provide golf-type game play, including for those with physical disabilities, as well as for a training and instructional aid for golf, lacrosse, and other sports.

Another objective is to alter the launch angle, speed, trajectory, and spin of the ball 124 at least partially dependent on: 1) the angle of the rails 104 relative to the handle 110; 2) the length of the rails 104; 3) the degree of curvature of the rails 104; and 4) the momentum generated with the whip-like throwing action.

Another objective is to throw the ball 124 into the targets 126 in the fewest number of throws, i.e., strokes.

Another objective is to provide an inexpensive way to play a golf-type game.

Those skilled in the art will recognize that golf is a club and ball sport in which players use various clubs to hit balls into a series of holes on a course in as few strokes as possible. The game is played on a course with an arranged progression of 18 holes. Each hole on the course must contain a tee box to start from, and a putting green containing the actual hole or cup. Golf clubs are used to hit the golf ball. Each club is composed of a shaft with a grip on the top end and a club head on the bottom. Long clubs, which have a lower amount of degree loft, are those meant to propel the ball a comparatively longer distance, and short clubs a higher degree of loft and a comparatively shorter distance. The present invention attempts to simplify the golf game by utilizing a throwing apparatus 102 and a larger target 126, rather than the multiple golf clubs and small hole target.

As referenced in FIG. 1, the kit 100 comprises a throwing apparatus 102 that is adapted to throw and putt a ball 124 towards at least one target unit 126. The throwing apparatus comprising a pair of elongated arced rails 104 pivotally join with a handle 110. The throwing apparatus 102 is useful for playing a golf-type game, including for those with physical disabilities, as well as for a training and instructional aid for golf, lacrosse, and other sports. Further each target unit 126 is an open container containing weighted granular substance such as sand so as to facilitate stable placement of the ball 124 in the target 126.

Figure 2:
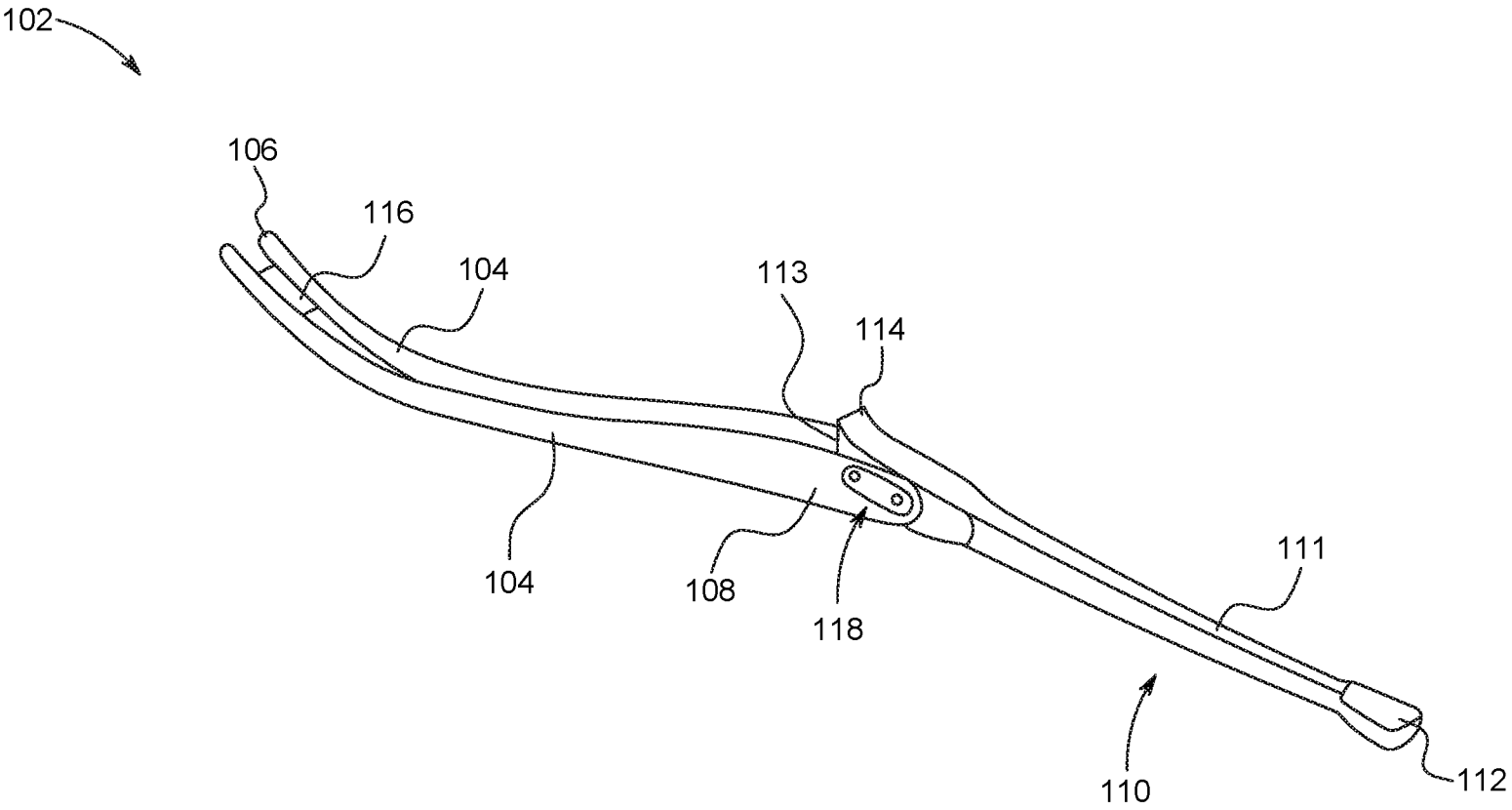
FIG. 2 illustrates a perspective view of the throwing apparatus shown in FIG. 1, in accordance with an embodiment of the present invention.

As shown in FIG. 2, the throwing apparatus 102 comprising a pair of elongated arced rails 104 and a handle 110, wherein the pair of rails 104 and the handle 110 pivots about a hinge 118 so as to allow for adjustments to the launch trajectory and speed of the ball 124 (shown in FIG. 1). Also, the pair of rails 104 can be interchanged with different rails having varying lengths and degrees of curvature. The rails 104 are arranged in a parallel, spaced-apart relationship. In one embodiment, the rails 104 are about 30"-32" long. At least one bridge 116 extends between the pair of rails 104 to enhance structural integrity. Suitable materials for the rails 104 may include, without limitation, wood, bamboo, a rigid polymer, fiberglass, aluminum, and a metal alloy.

Furthermore, the elongated arced pair of rails 104 of the throwing apparatus 102 having a rail junction end 108 and a rail terminus end 106. Further the elongated handle 110 having a handle junction end 114 and a handle terminus end 112. The handle junction end 114 terminates with a stop 113, wherein the stop 113 is a raised portion of the handle junction end 114 that is raised above the top surface of the pair of rails 104 so as to stop the ball sliding towards the handle of the throwing apparatus 102. The handle terminus end 112 may include a grip 111 for secure handling of the throwing apparatus 102. In one embodiment, the handle is about 13"-14" long. Suitable materials for the handle 110 may include, without limitation, wood, bamboo, a rigid polymer, fiberglass, aluminum, and a metal alloy.

In some embodiments, the rails 104 have a fixed degree of curvature and length. The rails 104 may be configured to achieve throws of different distance, launch angle, and trajectory, and to impart a desired spin from the rail terminus end 106. The rails 104 can be interchanged to achieve a throwing apparatus 102 having different lengths or degrees of curvature.

Figure 3:
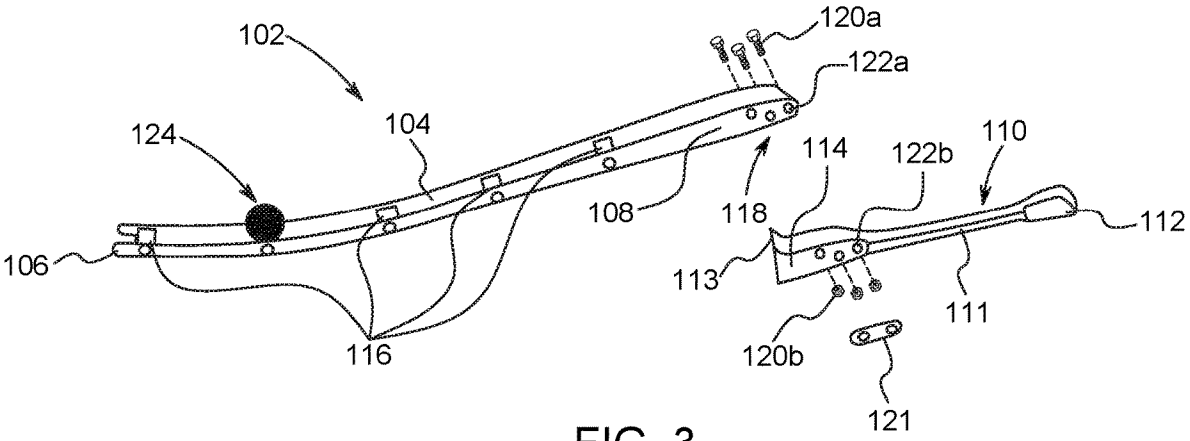
FIG. 3 illustrates an exploded view of the throwing apparatus showing a pair of rails detached from a handle at the hinge and a ball on the pair of rails, in accordance with an embodiment of the present invention.

Turning now to FIG. 3, the throwing apparatus 102 comprises a hinge 118 that is disposed between the rails 104 and the handle 110. The hinge 118 is configured to join the rail junction end 108 to the handle junction end 114 in a pivotal, adjustable, and detachable relationship. The pivotal articulation of the rails 104 relative to the handle 110 can be adjusted through manipulation of the hinge 118, so as to be snug. In this manner, the rails 104 are held in place during the whip-like throwing action, and when impacting the ball 124 during a putt. The hinge 118 can, however, be manipulated, so as to loosen or completely detach the rails 104 from the handle 110 for interchanging rails or cleaning. The hinge 118 comprises one or more screws or bolts 120*a* and nuts 120*b* and one or more washers or a washer plate 121. In another embodiment, at least one aperture 122*a* on the rail junction end 108 and at least one aperture 122*b* on the handle junction end 114 enable passage of the screw 120*a* through the rail junction end 108 and the handle junction end 114 so as to be aligned with the nuts 120*b*. The screw 120*a* and nuts 120*b* can be tightened by pressing the rail terminus end 106 against the handle terminus end 112. This tightening motion helps retain the rails 104 stationary in relation to the handle 110. The bolts 120*a* and nuts 120*b* can also be loosened to enable adjustability of the rails 104 relative to the handle 110. In this manner, the launch trajectory and speed of the ball 124 can be controlled. Further apart from screw 120*a* and nuts 120*b* other joining methods known in the prior art can be used to join the rail junction end 108 to the handle junction end 114 in a pivotal, adjustable, and detachable relationship without departing from the scope and spirit of the present invention.

The kit 100 further comprises a ball 124 that is configured to travel across the pair of rails 104. The ball 124 is supported by the edges of the rails and over the at least one bridge 116. In addition to throwing the ball, the rail terminus end 106 is shaped and dimensioned to enable putting the ball 124 short distances towards the target 126 by directly striking the ball 124. In another possible means to putt the ball 124, the throwing apparatus 102 does not strike the ball as in a typical golf putter. Rather, the handle terminus end 112 of the handle 110 sticks into the ground and the rails 104 are aligned with the target 126. The ball 124 is then rolled down the grooved rails 104 towards the target. The angle of the throwing apparatus 102 is determinative of the speed at which the ball 124 rolls along the rails 104. The ball 124 may be sized and dimensioned similar to a golf ball 124. Though a rubber or foam ball may also be used for safety purposes, however a ball of any material can be used without departing from the scope and spirit of the present invention.

Figure 4:
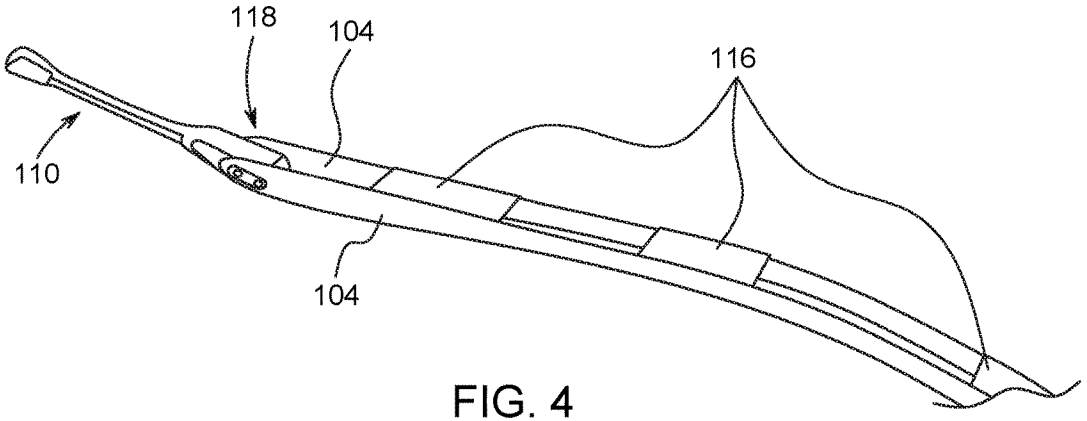
FIG. 4 illustrates a bottom view of the throwing apparatus showing an exemplary pair of rails having a plurality of bridges joining the pair of rails, in accordance with an embodiment of the present invention.

At least one bridge 116 extends between the pair of rails 104 to enhance structural integrity, wherein the bridges 116 comprises one or more plates or boards or sheet metal or the like attached to the bottom of the pair of rails 104, as shown in FIG. 4. In this manner, a whip-like throwing motion generates sufficient momentum to carry the ball 124 towards the rail terminus end 106 for throwing the ball 124.

In an exemplary embodiment as shown in FIG. 1 and FIG. 3, five dowels of ¾ inch are used between the pair of rails 104 as bridges 116 are used to enhance the structural integrity of the throwing apparatus 102. A continuous bridge connecting the bottom portion of the blades can be used, however, or any such design and any number of bridges can be used to enhance the structural integrity of the throwing apparatus 102 without departing from the scope and spirit of the invention.

Figure 5:
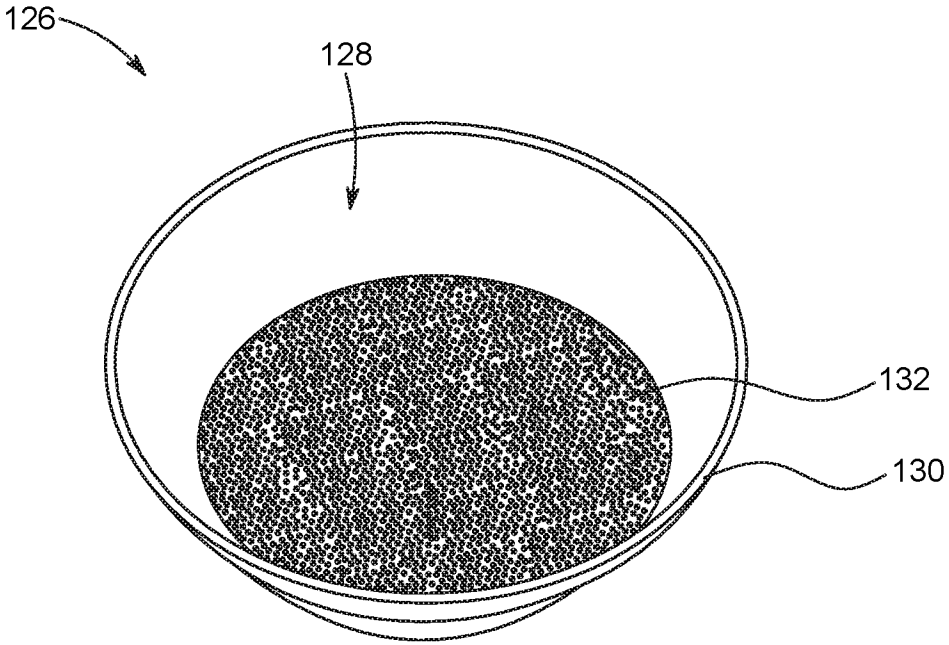
FIG. 5 illustrates a perspective view of an exemplary target unit, in accordance with an embodiment of the present invention.

Turning now to FIG. 5, the assembly 100 provides at least one target 126, towards which the ball 124 is thrown or putted. In one embodiment, the target 126 comprises a sidewall 130 that forms a target opening 128. The size of the target opening 128 may be increased or decreased to adjust the level of difficulty for the golf-type game. The objective of the game is to land the ball 124 in the target 126 with the least number of throws and putts.

In some embodiments, the target 126 may include a container and a weighted granular substance 132, such as sand. In one embodiment, the target 126 is a fifteen gallon bucket, or rubber tub, having a 26" diameter and being 9.75" tall. Though other shapes and dimensions may be used to increase or decrease the level of difficulty of the golf-type game. In one embodiment, the target 126 is a rubber tub. The tub filled with 50 lbs of sand provides a stable target 126 for throwing the ball 124 into the target.

In operation, one or more target units 126 can be set up along a playing course; whereby the objective is to throw the ball 124 into the target units 126 in the fewest number of attempts, or strokes. There could be many game variations.

Figure 6:
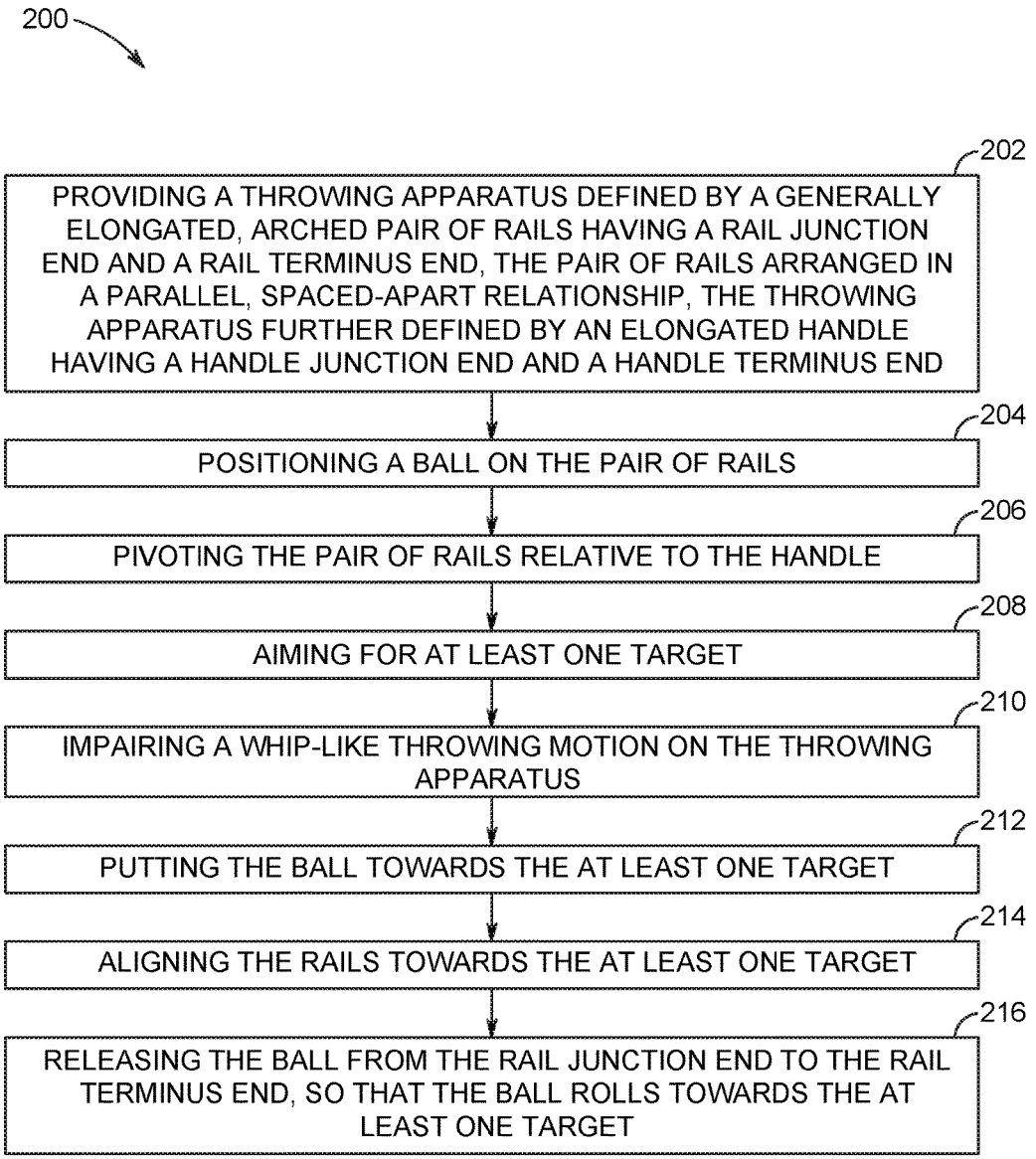
FIG. 6 illustrates a flowchart of an exemplary method for playing a golf-type game, in accordance with an embodiment of the present invention.

FIG. 6 illustrates a flowchart diagram of an exemplary method 200 for playing a golf-type game. The method 200 may include an initial Step 202 of providing a throwing apparatus 102 defined by a generally elongated, arced pair of rails having a rail junction end and a rail terminus end, the pair of rails arranged in a parallel, spaced-apart relationship, the throwing apparatus 102 further defined by an elongated handle having a handle junction end and a handle terminus end.

In some embodiments, the method 200 may further comprise a Step 204 of positioning a ball 124 on the pair of rails. A Step 206 includes pivoting the pair of rails relative to the handle. A Step 208 comprises aiming for at least one target 126. A Step 210 includes imparting a whip-like throwing motion on the throwing apparatus 102, whereby the whip-like throwing motion causes the ball 124 to launch from the rail terminus end of the throwing apparatus 102 towards the at least one target 126. A Step 212 may include putting the ball 124 towards the at least one target 126. A Step 214 comprises aligning the rails towards the at least one target. A Step 216 comprises releasing the ball from the rail junction end to the rail terminus end, so that the ball rolls towards the at least one target 126. A final Step 218 comprises repeating some or all of the above steps (202 to 216) to throw or putt the ball into all the targets in a minimum number of attempts. Further the throwing apparatus 102 can be used to throw the ball 124 with accuracy for short distances, for example, when the ball is close to the golf green or target 126. The throwing apparatus 102 can also be used to perform flop shots with ease and accuracy. Flop shot, also known as a lob shot, is a short pitch shot played with a very high-lofted wedge in order to create maximum height on the ball's trajectory to send the golf ball on a high-arching trajectory, steeply up and steeply down, so that when it lands on the green it stops quickly, with very little roll. Flop shots can be played utilizing a small variation in overhand throwing motion of the apparatus 102. Further the throwing apparatus can be used to play several types of shots including shots like, drive, approach, putt, lay-up, chip, punch and flop shots that are played in golf-type games.

Although the flowchart shows a specific order of executing the method 200, the order of executing the steps may be changed relative to the order shown in certain embodiments. Also, two or more steps shown in succession may be executed concurrently or with partial concurrence in some embodiments. Certain steps may also be omitted from the flow diagrams without departing from the scope and the spirit of the present invention.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A dual purpose apparatus that is configured to be interchangeably placed in a throwing mode for throwing a golf ball and a rolling mode for rolling the golf ball, the dual purpose apparatus comprising:

a pair of rails, wherein the rails are elongated, arced, having a rail junction end and a rail terminus end, the pair of rails are arranged in a parallel, spaced-apart relationship;

at least one bridge extending between the pair of rails, wherein the arced pair of rails is configured to retain the golf ball across the pair of rails and carry the golf ball towards the rail terminus end;

a handle, wherein the handle is defined by an elongated handle having a grip portion, a handle junction end, and a handle terminus end; and a hinge joint between the pair of rails and the handle, wherein the hinge joint is configured to pivotally and detachably join the rail junction end to the handle junction end;

wherein the dual purpose apparatus is configured to be interchangeably placed in one of the throwing mode and the rolling mode by at least:

the dual purpose apparatus being configured to be placed in the throwing mode at least by manipulation of the hinge to form a snug relationship between the pair of rails relative to the handle, whereby the snug relationship configures the dual purpose apparatus to be gripped by the handle for a throwing motion that generates sufficient momentum to carry the golf ball towards the rail terminus end for throwing the golf ball toward a target; and the dual purpose apparatus being configured to be placed in the rolling mode at least by the handle terminus end of the handle being stuck into ground and the rails aligned with the target to allow for the golf ball to be rolled down the rails toward the target.

2. The dual purpose apparatus of claim 1, wherein an angle of the rails relative to the handle, the length of the rails, the degree of curvature of the rails, and the momentum generated with a throwing motion of the throwing mode control launch angle, speed, trajectory, and spin of the golf ball.

3. The dual purpose apparatus of claim 1, wherein the pair of rails can be interchanged with different rails having varying lengths and degrees of curvature.

4. The dual purpose apparatus of claim 1, wherein the pair of rails pivots about the hinge, whereby the hinge comprises one or more nuts and bolts that can be loosened to enable adjustability of the rails relative to the handle thereby controlling launch trajectory and speed of the golf ball.

5. The dual purpose apparatus of claim 1, wherein five dowels of ¾ inch length are used between the pair of rails as bridges to enhance the structural integrity of the dual purpose apparatus.

6. The dual purpose apparatus of claim 1, wherein:

the pair of rails have a rail length between 30 and 32 inches inclusive;

the handle has a handle length between 13 and 14 inches inclusive; and based at least in part on the rail length of between 30 and 32 inches inclusive and the handle length of between 13 and 14 inches inclusive, a ratio of the rail length over the handle length is between 2.14 and 2.46 inclusive.

7. The dual purpose apparatus of claim 1, wherein the dual purpose apparatus is configured to be placed in the rolling mode at least in part by the handle terminus end of the handle being rested on the ground.

8. A kit for playing and practicing alternative game of golf, wherein the kit comprising:

at least one golf ball;

at least one target unit that includes a container and a weighted granular substance; and at least one dual purpose apparatus, wherein the dual purpose apparatus includes a pair of rails, at least one bridge extending between the pair of rails, a handle and a hinge joint between the pair of rails and the handle, whereby the pair of rails is defined by a generally elongated, arced pair of rails having a rail junction end and a rail terminus end, the pair of rails arranged in a parallel, spaced-apart relationship, further the arced pair of rails are configured to retain and carry the golf ball across the pair of rails, whereby the handle is defined by an elongated handle having a handle junction end and a handle terminus end, whereby the hinge joint is configured to pivotally and interchangeably join the pair of rails at the rail junction end with the handle at the handle junction end at a predetermined angle, whereby manipulation of the hinge forms a snug relationship between the pair of rails relative and the handle, whereby the dual purpose apparatus is configured to be interchangeably placed in one of a throwing mode and a rolling mode by at least:

the dual purpose apparatus being configured to be placed in the throwing mode at least by manipulation of the hinge to form the snug relationship between the pair of rails relative to the handle, whereby the snug relationship configures the dual purpose apparatus to be gripped by the handle for a throwing motion that generates sufficient momentum to carry the golf ball towards the rail terminus end for throwing the golf ball toward a target; and the dual purpose apparatus being configured to be placed in the rolling mode at least by the handle terminus end of the handle being stuck into ground and the rails aligned with the target to allow for the golf ball to be rolled down the rails toward the target.

9. The kit of claim 8, wherein the handle terminus end includes a grip for secure handling of the dual purpose apparatus.

10. The kit of claim 8, wherein the angle of the rails relative to the handle, the length of the rails, the degree of curvature of the rails, and the momentum generated with the throwing motion of the throwing mode control a launch angle, speed, trajectory, and spin of the golf ball.

11. The kit of claim 8, wherein the pair of rails pivots about the hinge, whereby the hinge comprises one or more nuts and bolts that can be loosened to enable adjustability of the rails relative to the handle thereby controlling launch trajectory and speed of the golf ball.

12. The kit of claim 8, wherein five dowels of ¾ inch length are used between the pair of rails as bridges to enhance the structural integrity of the dual purpose apparatus.

13. The kit of claim 8, wherein the targets comprise eighteen target units, whereby each target unit is an open bucket-shaped container having a bottom surface, a base of 26 inch diameter and side wall of 9.75 inch height and wherein a ratio of the base diameter over the side wall height is 2.7.

14. The kit of claim 8, wherein the weighted granular substance is sand.

15. A method for playing and practicing alternative game of golf with a kit comprising at least one golf ball, at least one dual purpose apparatus and at least one target unit, the method comprising: providing the at least one dual purpose apparatus, wherein the dual purpose apparatus is defined by a generally elongated, arced pair of rails having a rail junction end and a rail terminus end, the pair of rails arranged in a parallel, spaced-apart relationship, the dual purpose apparatus further defined by an elongated handle having a handle junction end and a handle terminus end, wherein the dual purpose apparatus is configured to be interchangeably placed in one of a throwing mode and a rolling mode; placing the dual purpose apparatus in the throwing mode at least by manipulation of a hinge to form a snug relationship between the pair of rails relative to the handle, whereby the snug relationship configures the dual purpose apparatus to be gripped by the handle for a throwing motion that generates sufficient momentum to carry the golf ball towards the rail terminus end for throwing the golf ball toward a target; positioning the golf ball on the pair of rails; aiming for at least one target; imparting a throwing motion on the dual purpose apparatus, placing the dual purpose apparatus in the rolling mode at least by sticking the handle terminus end of the handle into ground and aligning the rails with the target to allow for the golf ball to be rolled down the rails toward the target; aligning the rails towards the at least one target; releasing the golf ball from the rail junction end to the rail terminus end, so that the golf ball rolls over the rails towards the at least one target; and -6-repeating the above steps, repeatedly placing the dual purpose apparatus in at least one of the throwing mode or the rolling mode, and continuing to throw or roll the golf ball into all the targets in the minimum number of attempts.

16. The method of claim 15, wherein the angle of the rails relative to the handle, the length of the rails, the degree of curvature of the rails, and the momentum generated with the throwing action control a launch angle, speed, trajectory, and spin of the golf ball.

17. The method of claim 15, wherein the pair of rails can be interchanged with different rails having varying lengths and degrees of curvature.

18. The method of claim 15, wherein the pair of rails pivots about the hinge, whereby the hinge comprises one or more nuts and bolts that can be loosened to enable adjustability of the rails relative to the handle thereby controlling launch trajectory and speed of the golf ball.

19. The method of claim 15, wherein the rail terminus end is shaped and dimensioned to enable putting the golf ball short distances towards the target by directly striking the golf ball, including a bridge bridging the pair of parallel rails in proximity to their ends, wherein putting that includes directly striking the golf ball is performed with the dual purpose apparatus in throwing mode.

20. The method of claim 15, wherein the placing the dual purpose apparatus in the rolling mode at least by sticking the handle terminus end of the handle into ground and aligning the rails with the target to allow for the golf ball to be rolled down the rails toward the target is performed instead of conventional putting in which the golf ball is struck with a putter.

21. The method of claim 15, wherein the dual purpose apparatus in throwing mode can be used to play several types of shots including shots like, drive, approach, putt, lay-up, chip, punch and flop shots that are played in golf-type game.

* * * * *